United States Patent [19]

McDonald et al.

[11] 4,329,676

[45] May 11, 1982

[54] POTENTIOMETER

[75] Inventors: Gerald H. McDonald, Blaine; Donald R. Hagen, Brooklyn Center, both of Minn.

[73] Assignee: Resistance Technology, Inc., Roseville, Minn.

[21] Appl. No.: 110,802

[22] Filed: Jan. 10, 1980

[51] Int. Cl.[3] ..... H01C 10/50

[52] U.S. Cl. ..... 338/198; 338/163; 338/164; 338/172; 338/184; 338/188

[58] Field of Search ..... 338/160, 162, 163, 164, 338/671, 172, 175, 184, 188, 198, 199, 200, 202, 325

[56] References Cited

U.S. PATENT DOCUMENTS

| | | | |
|---|---|---|---|
| 2,081,227 | 5/1937 | de Vries | 252/511 X |
| 3,123,795 | 3/1964 | Bender | 338/172 |
| 3,355,693 | 11/1967 | Van Benthuysen et al. | 338/184 |
| 3,597,720 | 8/1971 | Burgess | 338/202 |
| 3,601,743 | 8/1971 | Mathison et al. | 338/164 |
| 3,629,780 | 12/1971 | Burcham | 338/198 |
| 3,906,429 | 9/1975 | Rhodes | 338/171 X |
| 4,081,782 | 3/1978 | Hildreth et al. | 338/198 X |
| 4,117,444 | 9/1978 | Hildreth et al. | 338/164 X |

FOREIGN PATENT DOCUMENTS

| | | | |
|---|---|---|---|
| 478448 | 9/1969 | Switzerland | 338/164 |

*Primary Examiner*—C. L. Albritton

*Attorney, Agent, or Firm*—Burd, Bartz & Gutenkauf

[57] ABSTRACT

A potentiometer providing a variable electrical resistance between input and output terminals for use in electronic circuits, as for volume control, light control, instrumentation control or the like. A potentiometer includes a housing assembly comprised of a cover assembled to a base. An electrical wiper is mounted to a rotor assembled to the cover and has a contact portion movable along a C-shaped resistive strip on the base. Stops limit the extremes of movement of the wiper with respect to the resistive strip. An annular seal disposed between the cover and a rotating portion of the rotor is effective to keep out dirt and other particulate matter from the potentiometer and provides continuous brake friction upon rotation of the rotor. In one form of the potentiometer, the housing assembly includes a body located between the cover and base and a switch mechanism is operably connected to the rotor to selectively locate an electrical contact in an on or off position.

46 Claims, 18 Drawing Figures

POTENTIOMETER

SUMMARY OF INVENTION

The invention relates to the field of potentiometers which provide a variable and calibrated resistance between input and output terminals. A base and a cover together form a housing assembly having a chamber. A rotor rotatably assembled to the cover has a rotor stem located in the chamber carrying an electrical wiper. A rotatable control knob is mounted on the rotor. A C-shaped electrical resistive strip is fastened to the base. The electrical wiper has a contact portion in sliding engagement with the resistive strip. Rotation of the rotor is effective to move the contact portion of the wiper along the resistive strip and vary the resistance between the input and output terminals of the potentiometer. The wiper has a stop which engages a shoulder extended from the base when the wiper has reached extreme limits of travel either way on the resistive strip to locate the wiper relative to a stop between the control knob and cover. An annular seal between the rotor and the cover is effective to prevent dirt and other matter from entering the potentiometer and provides a continuous friction brake function against the turning of the rotor. The output terminals can be configured as plug prongs to connect the potentiometer to an electrical device, such as a hearing aid. In one form of the invention an on-off switch mechanism is mounted on a body between the base and cover. The switch mechanism includes a cam mounted on the rotor stem for rotation therewith and a movable contact engageable with the cam to hold the contact in an open or off position. A wiper mounted on the rotor stem engages an electrical resistance strip to control the electrical characteristics of the potentiometer.

IN THE DRAWINGS

DESCRIPTION OF PREFERRED EMBODIMENTS

Figure 1:
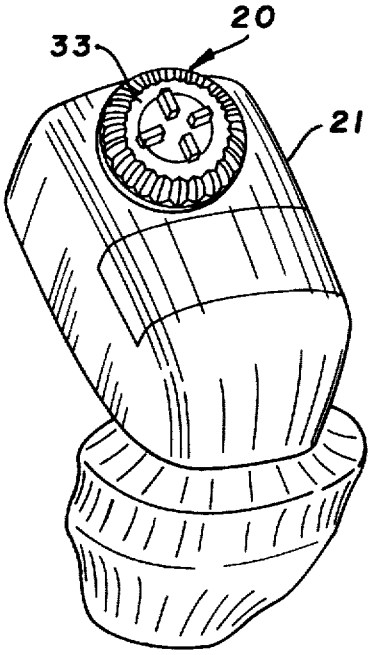
FIG. 1 is a perspective view of a hearing aid equipped with a potentiometer according to one form of the present invention.
Figure 2:
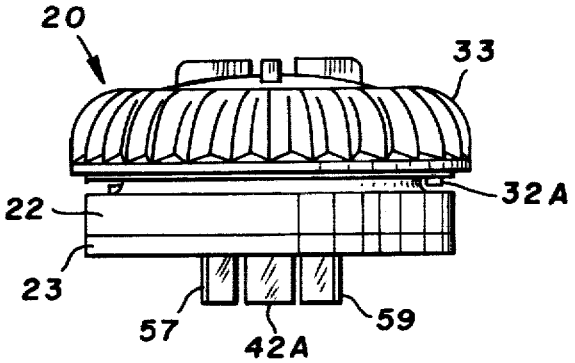
FIG. 2 is a side elevational view of the potentiometer of the invention.
Figure 3:
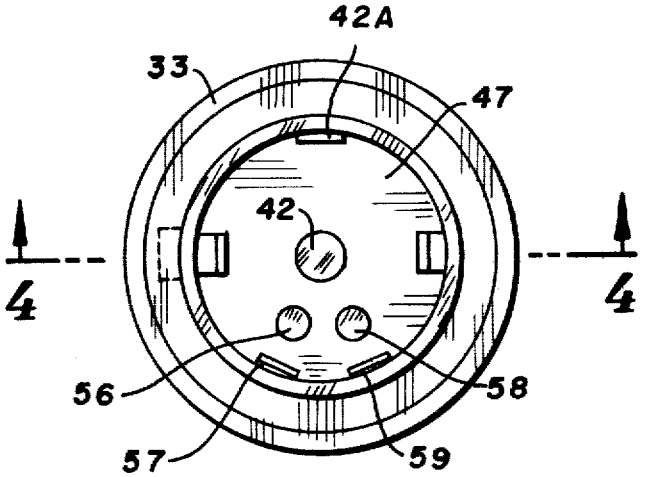
FIG. 3 is a bottom plan view of the potentiometer shown in FIG. 2.

Referring to the drawings, a potentiometer 20, according to one form of the present invention, is shown in FIG. 1 installed as a volume control on a hearing aid 21 of the variety carried proximate the ear. FIG. 2 shows potentiometer 20 remote from hearing air 21. Potentiometer 20 provides a variable electrical resistance between input and output terminals 42A, 57, and 59 whereby it is useful in electronic circuits, as for volume control, light control, instrumentation control, and the like.

Figure 4:
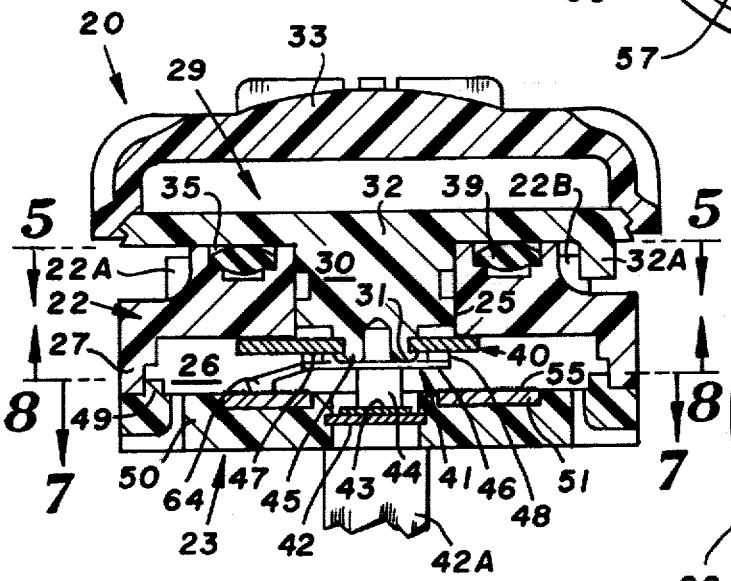
FIG. 4 is a sectional view of the potentiometer shown in FIG. 3 taken along the line 4—4 thereof.
Figure 5:
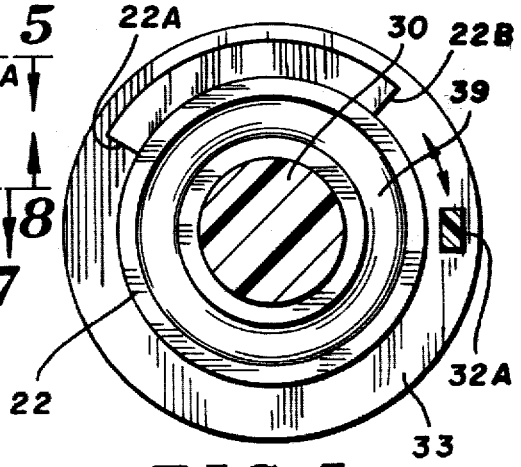
FIG. 5 is a sectional view of the potentiometer shown in FIG. 4 taken along the line 5—5 thereof.

Referring to FIG. 4, potentiometer 20 includes a housing assembly comprised of a generally annular cover 22 assembled to a base 23. Cover 22 has a central passage 25 opening inwardly to an enlarged pocket or chamber 26 circumferentially defined by a stepped interior side wall 27. A rotor 29 is assembled for axial rotation in central passage 25. Rotor 29 includes a rotor shaft 30 rotatably engaged in passage 25 having a rotor stem 31 extending into chamber 26 of cover 22. A disc-like head 32 is disposed at the opposite or outer end of rotor shaft 30. Head 32 extends laterally outward beyond the top edge of the outer face of cover 22. An outer edge section of head 32 has a downwardly projected ear or tab 32A that contacts stops 22A and 22B on cover 22. As shown in FIG. 5, stops 22A and 22B are circumferentially spaced about 90 degrees from each other. The limits of rotation of knob 33 are determined by the engagement of tab 32A with the stops 22A and 22B. A control knob 33 is secured to head 32 for manual rotation of rotor shaft 30 between the angular limits set by stops 22A and 22B.

Figure 6:
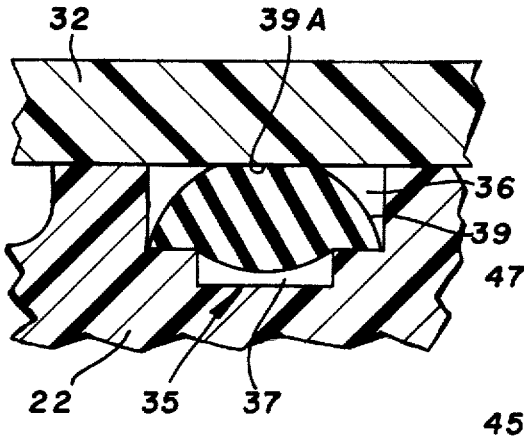
FIG. 6 is an enlarged sectional view of a seal installed in the potentiometer of FIG. 4.

As shown in FIGS. 4, 5, and 6, the outward face of cover 22 opposite base 23 has an annular groove or channel 35. Referring to FIG. 6, channel 35 has a rectangular outward annular section 36 and a smaller second rectangular inward annular section 37. A flexible annular seal or ring 39 is located in groove 35 and is compressed therein by the inside surface of head 32. Seal 39 has a normal, uncompressed semi-circular cross sectional shape. As shown in FIG. 6, in the compressed form seal 39 spreads to fill the interior corners of outward section 36 of groove 35 and expands slightly into the inward section 37 of groove 35 to bias an annular surface 39A thereof into annular surface engagement with head 32. Seal 39 effectively prevents dust and other particulate matter from entering potentiometer 20. It also provides a resilient surface 39A for continuous annular surface contact with the interior annular surface of head 32 of rotor 29 as it is rotated with respect to cover 22 to alter the resistance between input and output terminals of the potentiometer. Seal 39 also provides a relatively constant friction drag on head 32 as it is turned, as annular section 37 of groove 35 has an annular space allowing limited expansion of the seal. The cross sectional shape of the seal can change so that the seal provides a substantially constant biasing force on head 32 and thereby controls the amount of torque required to turn rotor 29. Seal 39 functions as a continuous friction brake which holds rotor 29 in a selected circumferential position.

Figure 7:
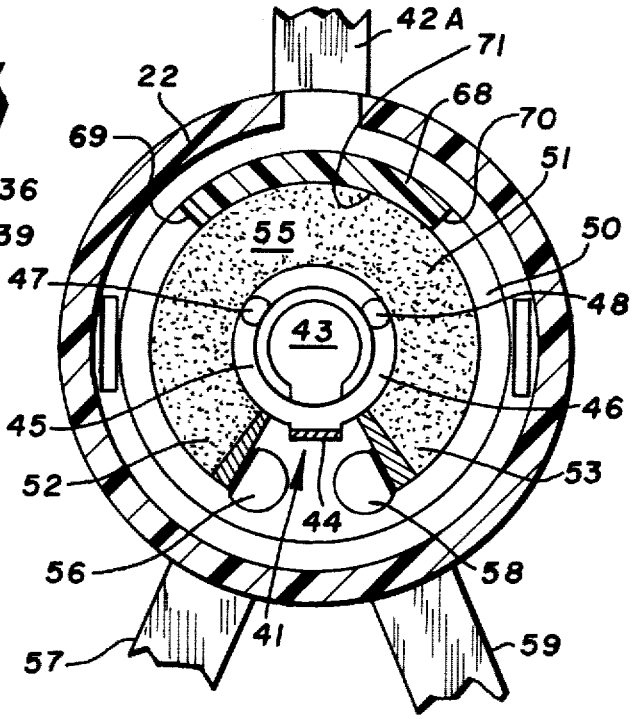
FIG. 7 is an enlarged sectional view of the potentiometer of FIG. 4 taken along the line 7—7 thereof.
Figure 8:
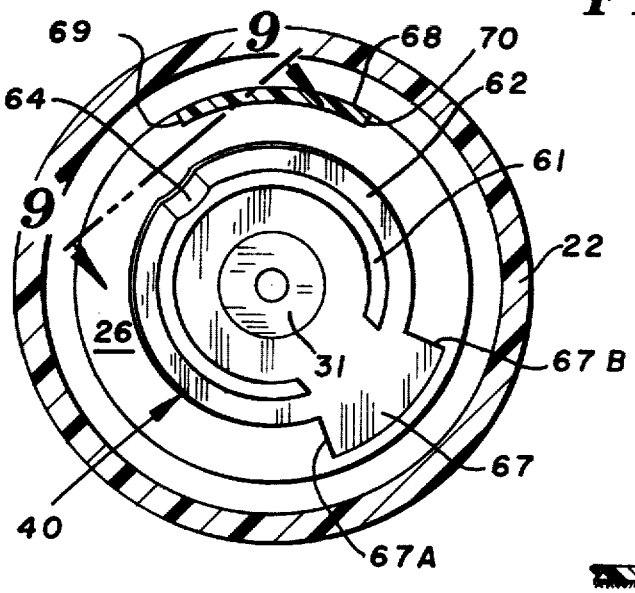
FIG. 8 is an enlarged sectional view of the potentiometer shown in FIG. 4 taken along the line 8—8 thereof.

A disc-like electrical wiper, indicated generally at 40 in FIGS. 4 and 8, is mounted in a circumferential groove located near the end of rotor stem 31 for rotation with rotor 29. The detailed structure and operation of wiper 40 is hereinafter described. Referring to FIGS. 4 and 7, an electrical connector 41 couples a conductor strip 42 in base 23 with wiper 40. Strip 42 extends outwardly from base 23 forming prong 42A or a first terminal. Connector 41 has a first member 43 in contact with strip 42, a second member or neck 44 connected to member 43, and a pair of curved arms 45 and 46 connected to neck 44 and located in sliding contact with wiper 40. The arms 45 and 46 have free ends with contact sections 47 and 48 that engage or ride on an annular part or ring 63 of wiper 40 and make electrical contacts therewith.

Figure 9:
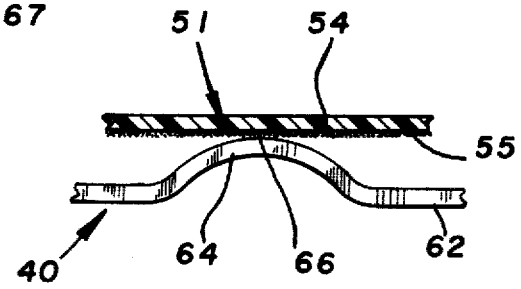
FIG. 9 is an enlarged view of a portion of the potentiometer shown in FIG. 8 taken along the line 9—9 thereof.

Returning to FIG. 4, base 23 has a stepped exterior wall 49 that fits in the stepped interior wall 27 of cover 22. A flat transverse base wall 50 extends between side walls 49 closing the chamber 26. A C-shaped resistive strip 51 is positioned in a C-shaped recess or flat groove in the upper surface of base wall 50 in facing relationship to cover 22. Resistive strip 51 is in the shape of an interrupted washer having opposite ends 52 and 53, as shown in FIG. 7. Resistive strip 51 is preferably non-electrical conducting material having an electrically conductive coating 55. The electrical conductive coating 55 provides electrically calibrated graduated resistance along the length of the strip. As shown in FIG. 9, strip 51 has a non-electrical conductive base or substrate 54 and a coating 55 of electrical conductive material. The electrical conductive material can be the subject matter disclosed in U.S. Pat. No. 3,249,599. Coating 55 can be one or more layers of a mixture of materials, as silver and graphite, sprayed onto one side of base 54. Other materials and methods of attaching the coating to the base can be used to make strip 51.

A first electrical conductive member 56 is embedded in base wall 47 and electrically connected to one end 52 of resistive strip 51. Member 56 is connected to a leg or prong 57 extended from base wall 47 and turned outward to form a second terminal. A second electrical conductive member 58 embedded in wall 47 is connected to end 52 of strip 51. Member 58 is joined to a prong 59 forming a third terminal. Ends 52 and 53 of resistive strip 51 are electrically connected to members 56 and 58, respectively, by welding or soldering.

As shown in FIG. 8, wiper 40 assembled to the rotor stem 31 is generally disc shaped. A curved interior circumferential slot 61 in wiper 40 separates a circumferential, resilient contact rim 62 from an inside washer or ring 63. Rim 62 is curved away from the plane of the remainder of wiper 40 and has an intermediate contact portion 64 biased into contact with the coating 55 of resistive strip 51. Contact portion 64 is slidable along the surface of coating 55 upon rotation of rotor 29 by rotation of rotor knob 33. As shown in FIG. 9, contact portion 64 is an arcuate or downwardly curved section of rim 62 located generally mid-way between the fixed ends of rim 62. The middle part of contact portion 64 has a contact area 66 that engages coating 55.

An arm or projection 67 extends radially outward from wiper 40 opposite contact rim 62. Arm 67 has circumferentially spaced edges 67A and 67B. A shoulder or arcuate rib 68 extends from the base wall 47 of base 23 into chamber 26 in position to be in obstructing relationship to the path of travel of arm 67 on wiper 40 as wiper 40 is rotated. Shoulder 63 provides two stops 69 and 70 for the path of movement of the arm 67. As shown in FIG. 7, rib 68 has an inside arcuate surface 71 in engagement with an arcuate segment of strip 51. When wiper 40 is mounted on stem 31, it may not be circumferentially located relative to the stops 22A and 22B and tab 32A. Knob 33 is rotated to move arm 67 into engagement with one stop 69 or 70 of rib 68. This prevents further movement of wiper 40 and located contact portion 64 at one end of strip 51. The turning of knob 33 is continued until tab 32A engages one of the stops 22A or 22B. Knob 33 is now circumferentially orientated with contact portion 64 of wiper 40 and the ends of strip 51.

The variable resistance of the circuit is determined by the location of contact portion 64 on the coating 55 of resistive strip 51. The circuit is formed through the terminals 42A, 57, and 59. Connector 41 carries current from wiper 40 to terminal 42A. The electrical resistance characteristics of the circuit are regulated by rotating knob 33. This changes the location of contact portion 64 relative to the ends 52 and 53 of strip 51. Maximum rotation of knob 33 is determined by the circumferential distance between stops 22A and 22B.

Figure 10:
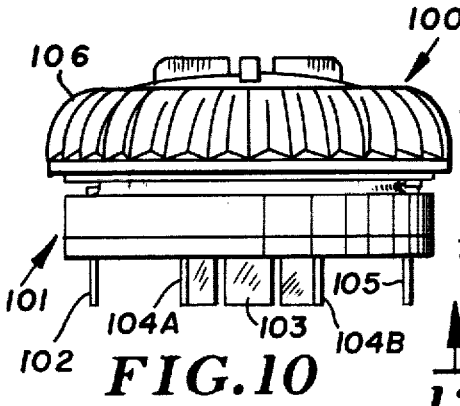
FIG. 10 is a side view of a modification of the potentiometer of the invention.
Figure 11:
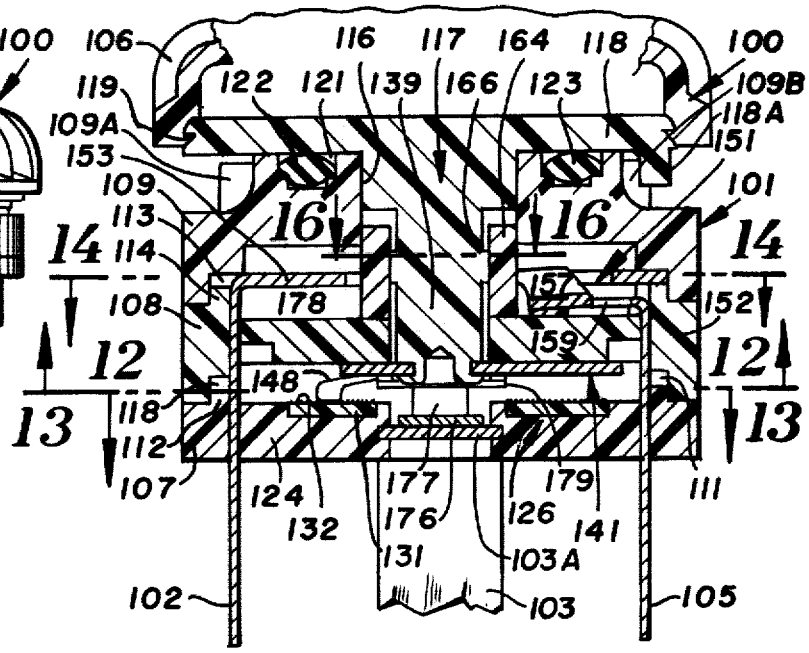
FIG. 11 is an enlarged vertical cross sectional view of the potentiometer of FIG. 10.

Referring to FIGS. 10 and 11, there is shown a potentiometer indicated generally at 100, according to a second form of the invention. Potentiometer 100 has a housing assembly indicated generally at 101 carrying a plurality of electrical leads, legs or terminals 102, 103, 104A, 104B, and 105. A rotatable control knob 106 is located adjacent the upper end of housing assembly 101 to control the resistance characteristics and turn the potentiometer on and off.

Housing assembly 101 has a circular base 107 attached to an annular body 108. A cup-shaped cover 109 is mounted on body 108. Body 108 has an internal bottom annular groove 111 accommodating an upwardly directed flange or lip 112 of base 107. Cover 109 has an annular groove 113 accommodating an upwardly directed annular lip 114 of body 108. Base 107, body 108, and cover 109 are secured together to form a unitary housing assembly 101.

Cover 109 has a central axial bore 116 rotatably accommodating a rotor or cylindrical member 117 and a pair of stops 109A and 109B. Rotor 117 has a flat circular transverse head 118 located in engagement with the upper end surface of cover 109, as viewed in FIG. 11. Head 118 has a downwardly directed tab 118A and a grooved outer peripheral edge 119 to accommodate control knob 106. Tab 118A is moved into contact with both stops 109A and 109B to establish the limits of rotation of rotor 117. Cover 109 has an annular groove 121 open to head 118. An annular resilient seal member or ring 122 located in groove 121 functions as a seal and continuous friction brake of head 118. Ring 122 is located in sealing frictional engagement with an annular portion of the flat bottom surface 123 of head 118. Ring 122 is identical to ring 39 shown in detail in FIG. 6.

Figure 12:
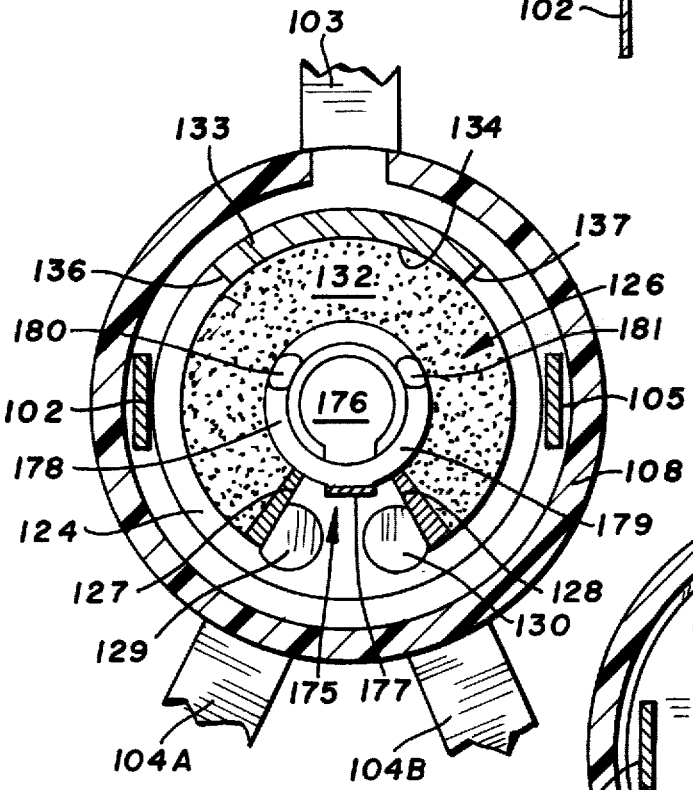
FIG. 12 is a sectional view taken along line 12—12 of FIG. 11.

Base 107 has a bottom wall 124 having an annular recess or flat groove accommodating an electrically resistant element or strip indicated generally at 126. As shown in FIG. 12, resistant strip 126 is an interrupted circular member or C-shaped member having ends 127 and 128 in engagement with short bosses or members 129 and 130 of electrical conductive material extended upwardly from and integral with wall 124. An arcuate rib or shoulder 133 extends upwardly from wall 124 diametrically opposite bosses 129 and 130. Rib 133 has an inside arcuate surface 134 which engages an arcuate outer portion of strip 126. The groove in wall 124, inside surface 134 and bosses 129 and 130 provide locating structure or means for positioning strip 126 on wall 124 concentric with the axis of rotation of rotor 117. Rib 133 has an arcuate shape and circumferentially spaced ends 136 and 137.

Strip 126 has a flat C-shaped substrate or bases 131 of non-electrically conductive material. The top surface of substrate 131 is covered with an electrically resistant coating 132. The coating can be sprayed onto the strip and comprises selected coating materials to provide for the predetermined resistance characteristics of the coating 132. For example, the coating can be the coating as defined in U.S. Pat. No. 3,249,559.

Figure 13:
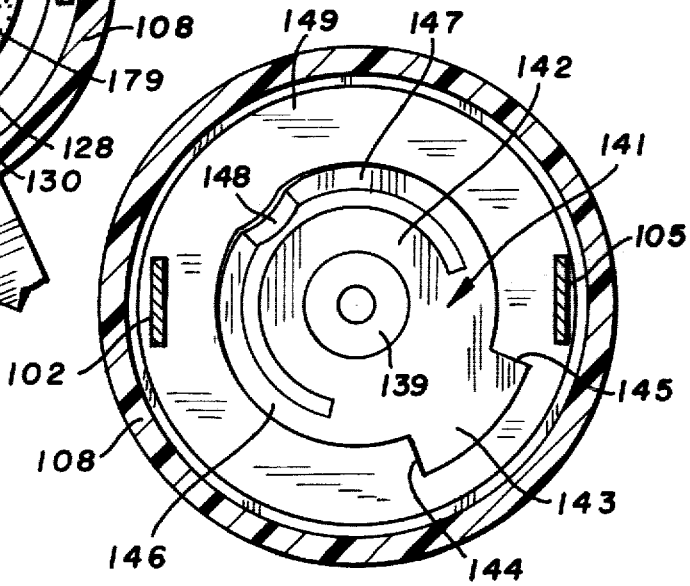
FIG. 13 is a sectional view taken along line 13—13 of FIG. 11.

As shown in FIG. 11, rotor 117 has a downwardly directed stem 139 that is located along the longitudinal axis of the potentiometer. A wiper indicated generally at 141 is attached to the lower end of stem 139 in a manner so that the wiper rotates with stem 139. Wiper 141 has a ring or circular body 142 having a central hole accommodating a portion of the lower end of stem 139. Body 142 is located in a groove in the lower end of stem 139 and clamped thereto. A dove-tailed projection or arm 143, as shown in FIG. 13, extends radially outwardly from body 142. Projection 143 has ends 144 and 145 located in the path or plane of rib ends 136 and 137. Ends 144 and 145 abut against ends 136 and 137 to limit the rotation of the rotor 117 to approximately 220 degrees and provide circumferential orientation structure for wiper 141 relative to knob 106. When wiper 141 is mounted on stem 139 it may not be circumferentially located relative to stops 109A and 109B. Stops 109A and 109B determine the opposite end locations of contact section 148 on strip 126. When knob 106 is first rotated wiper 141 is turned until arm 143 engages one end 136, 137 of stop 133. This locates contact section on one end of strip 126 as ends 136 and 137 are about diametrically opposite strip ends 127 and 128 and arm 143 is diametrically opposite contact section 148. The turning of knob 106 is continued until tab 118A engages a cover stop 109A or 109B. Knob 106 is now circumferentially orientated with contact portion 148 and the ends of strip 126.

A pair of arcuate arms or rims 146 and 147 extend from body 142 to contact or wiping section 148 that engages the electrically resistant coating 132 on resistant strip 126. Arms 146 and 147 extend in a circumferential direction and function as springs to bias the contact section 148 into engagement with coating 132. Contact section 148 is identical to the contact section 64, as shown in FIG. 9. Contact section 148 has a generally spherical outside surface that has an area contact with coating 132.

An electrical connector indicated generally at 175 couples the middle of conductor 103 with wiper 141. Connector 175 is identical to connector 41. As shown in FIG. 12, connector 175 has a first member 176 in contact with conductor 103, a second member or neck 177 connected to member 176, and a pair of curved arms 178 and 179 connected to neck 177. Arms 178 and 179 have outer or free ends 180 and 181, respectively, that engage ring 142 of wiper 141.

A switch mechanism indicated generally at 151 is operable to open the electrical circuit of the potentiometer on rotation of the control knob 106 to an off position. The control knob 106 also functions as a manual control to vary the volume or electrical output of the potentiometer. As shown in FIG. 11, body 108 has a circular wall or disc 152. Disc 152 is a flat, non-electrically conductive member that has flat top surface and an inner hole surrounding the lower end of stem 139. Outer peripheral sections of disc 152 have holes for prongs 102 and 105. Prong 102 is joined to a flat ring 153 surrounding the midsection of stem 139. An outer portion of rim 153 is clamped between body 108 and cover 109, as shown in FIG. 11.

Figure 14:
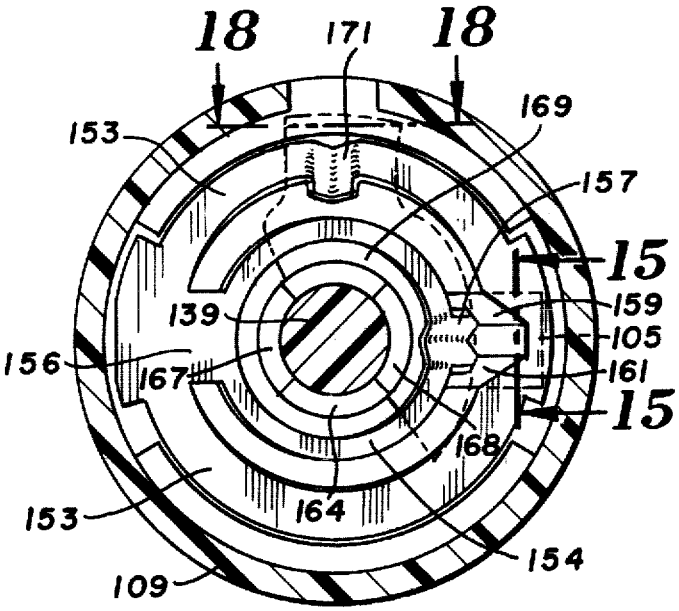
FIG. 14 is a sectional view taken along line 14—14 of FIG. 11.
Figure 15:
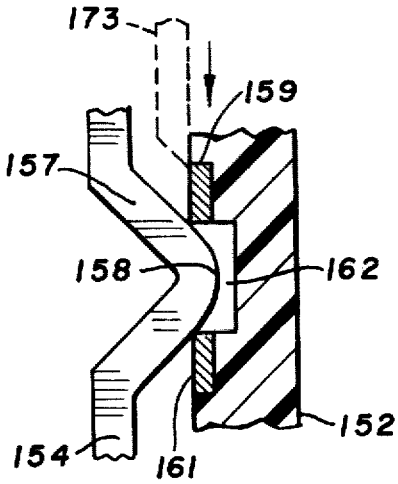
FIG. 15 is an enlarged sectional view taken along line 15—15 of FIG. 14.

Referring to FIG. 14, concentrically disposed within rim 153 is an annular member or ring 154. Member 154 is connected to rim 153 with a flexible neck 156. Diametrically opposite neck 156 is a contact section 157. As shown in FIG. 15, contact section 156 has a convex curved engaging face 158 that is in electrically conductive contact with a pair of contacts or members 159 and 161 connected to prong 105. Contacts 159 and 161 are located on opposite sides of a recess or groove 162 in wall 152 so that wall 152 does not interfere with the concurrent engagement of contact section 157 with contacts 159 and 161. Ring 154 biases and holds contact section 159 in engagement with contacts 159 and 161.

Figure 16:
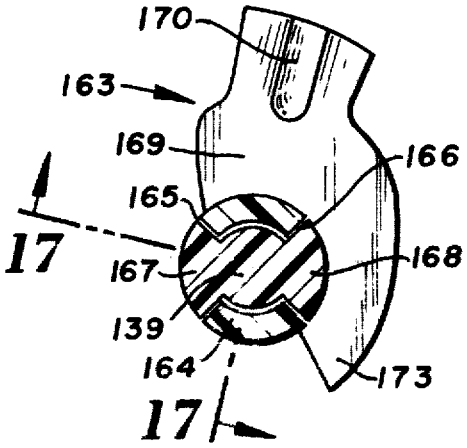
FIG. 16 is an enlarged sectional view taken along line 16—16 of FIG. 11.
Figure 17:
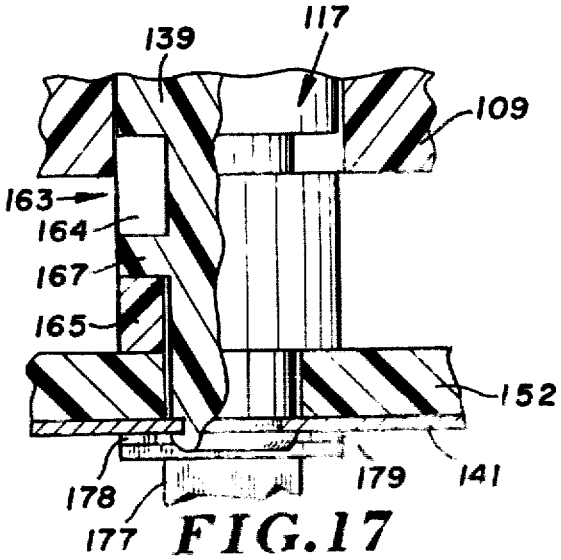
FIG. 17 is a sectional view taken along line 17—17 of FIG. 16.
Figure 18:
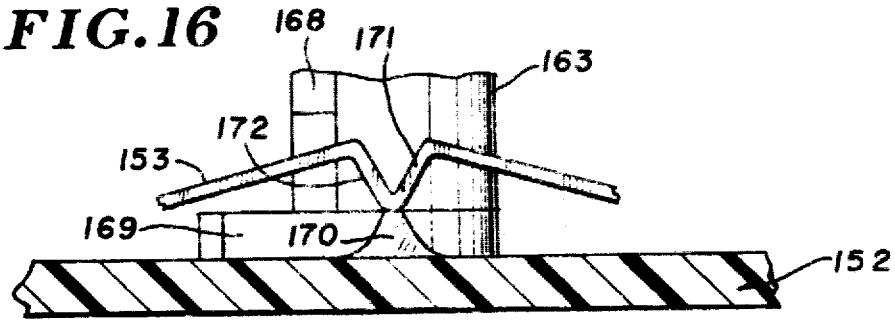
FIG. 18 is an enlarged sectional view taken along line 18—18 of FIG. 14.

A cam indicated generally at 163 drivably connected to rotor stem 139 is operable to move contact section 157 off of the contacts 159 and 161. As shown in FIGS. 16 and 17, cam 163 has a cylindrical sleeve 164 having arcuate slots or cut-out sections 165 and 166. Stem 139 has arcuate ribs 167 and 168 that are located in slots 165 and 166 thereby drivably connecting stem 139 to cam 163. An outwardly directed sector flange 169 is joined to the lower side of sleeve 164. Flange 169 has an outwardly directed upright tooth 170 which serves as a projection or lifting member to raise ring 153, as shown in FIG. 18, to relieve the contact biasing force on contact section 157.

Ring 153 has a downwardly directed V-portion or foot 171 having an inclined rear surface 172. When cam 163 is rotated, tooth 170 engages surface 172 thereby raising ring 153. This reduces the biasing action of ring 153 on contact section 157. Flange 169 has a forward lip 173 that is about 120 degrees in front of or clockwise of tooth 170. Lip 173 tapers downwardly in a forward direction and functions as a wedge or lift member which moves under contact section 157 to lift contact section 157 from contacts 159 and 161. This opens the switch. As shown in FIG. 18, the top of tooth 170 is flat and engages the bottom of foot 171. This condition occurs when knob 106 has been turned to the off position. When knob 106 is in the off position, tab 118A engages stop 109A and wiper contact section 148 is in contact with end 128 of strip 126.

Base 107 and cover 109 of potentiometer 100 are identical to the base and cover of potentiometer 20. In addition, the wipers 40 and 141, connectors 41 and 175, resistive strips 51 and 126 are interchangeable. This makes the potentiometers economical to manufacture as there are a minimum of different parts between the potentiometers.

Both potentiometers 20 and 100 have self-adjusting wipers. The wipers are indexed relative to the rotor stops 22A and 22B, 109A and 109B, with the stop tabs on the rotor heads. When the tab engages a stop, the wiper is automatically held at one end of the resistive strip. This is accomplished with the use of internal stops 136 and 137 in the base. The stops 136 and 137 hold the wiper in a fixed angular position until the rotor tab engages an external stop 22A, 22B, 109A or 109B. This fixes the angular location of the wiper on the rotor so that the limits of rotation of the wiper during use of the potentiometer are determined by the external stops. Thus, accurate manual mounting of the wiper on the rotor is not required.

While there is shown and described two embodiments of the potentiometer of the invention, it is understood that changes in structure, resistance materials, and arrangements of parts can be made by one skilled in the art without departing from the invention. The invention is defined in the following claims.

The embodiments of the invention in which an exclusive property or privilege is claimed are defined as follows:

1. A potentiometer comprising: housing means having a chamber; a rotor having a stem rotatably assembled on the housing means, said stem extending into the chamber and said rotor having a portion extending outside of the chamber and housing means for manual manipulation to rotate the stem; an electrical wiper located on the stem, said wiper having a contact portion; a C-shaped resistive strip mounted on the housing means in the chamber, said strip having a first end and a second end with variable electrical resistance means between the first end and the second end; first terminal means electrically connected to the wiper; second terminal means electrically connected to the resistive strip; said wiper having contact means in engagement with the resistive strip and rotatable with the rotor stem from the first end of the resistive strip to the second end of the resistive strip whereby the resistance between the first terminal means and the second terminal means is varied; annular resilient means cooperating with the housing means and rotor for continuous friction braking said rotor; and means attached to the housing means and engageable with the rotor for limiting rotation of the rotor to allow the contact portion to move between the first end and second end of the resistive strip, said means attached to the housing means for limiting rotation of the rotor between first and second positions, and second means attached to the housing means engageable with the wiper to limit rotation of the wiper between the first and second ends of the resistive strip, said wiper engaging said second means on initial rotation of the rotor to hold the wiper in an end position until the rotor engages the first means whereby the wiper is circumferentially oriented with the rotor.

2. The potentiometer of claim 1 wherein: said annular resilient means has a circular surface located in engagement with said portion of the rotor.

3. The potentiometer of claim 2 wherein: the resilient means is a circular member having a generally semi-circular cross section.

4. The potentiometer of claim 1 wherein: said housing means has an annular groove means open to the portion of the rotor, said annular resilient means being located in said groove and having a circular surface biased in engagement with said portion.

5. A potentiometer comprising: housing means having a chamber; a rotor having a stem rotatably assembled on the housing means, said stem extending into the chamber and said rotor having a portion extending outside of the chamber and housing means for manual manipulation to rotate the stem; an electrical wiper located on the stem, said wiper having a contact portion; a C-shaped resistive strip mounted on the housing means in the chamber, said strip having a first end and a second end with variable electrical resistance means between the first end and the second end; first terminal means electrically connected to the wiper; second terminal means electrically connected to the resistive strip; said wiper having contact means in engagement with the resistive strip and rotatable with the rotor stem from the first end of the resistive strip to the second end of the resistive strip whereby the resistance between the first terminal means and the second terminal means is varied; annular resilient means cooperating with the housing means and rotor for continuous friction braking said rotor; and means attached to the housing means and engageable with the rotor for limiting rotation of the rotor to allow the contact portion to move between the first end and second end of the resistive strip, said housing means having annular groove means open to a portion of the rotor, said annular groove means comprising a first groove having a bottom and an open top facing said portion of the rotor, and a second groove in the bottom of the first groove, said bottom having annular portions located adjacent opposite sides of the second groove, said annular resilient means being located in said first groove in engagement with said annular portions and expandable into said second groove.

6. The potentiometer of claim 5 wherein: said annular resilient means has a generally semi-circular cross section.

7. The potentiometer of claim 5 wherein: said first and second grooves are circular, and said annular resilient means is a circular resilient ring having a generally semi-circular cross section.

8. The potentiometer of claim 7 wherein: said circular ring has a convex curved surface facing the portion of the rotor, an annular portion of said convex curved surface being biased into engagement with said portion of the rotor.

9. The potentiometer of claim 5 wherein: said portion of the rotor includes a head having an annular surface, said annular resilient means being located in friction braking engagement with said annular surface.

10. The potentiometer of claim 1 wherein: said rotor includes a head having an annular surface, said housing means has an annular groove means open to the annular surface of the head, said annular resilient means being located in said groove means and having a circular surface biased into engagement with said annular surface.

11. The potentiometer of claim 10 wherein: said annular groove means has a first groove having a bottom and an open top facing said annular surface, and a second groove in the bottom of the first groove, said bottom having annular portions located adjacent opposite sides of the second groove, said annular resilient means being located in said first groove in engagement with said annular portions and expandable into said second groove.

12. The potentiometer of claim 11 wherein: said annular resilient means has a generally semi-circular cross section.

13. The potentiometer of claim 11 wherein: said first and second grooves are circular, and said annular resilient means is a circular resilient ring having a generally semi-circular cross section.

14. The potentiometer of claim 13 wherein: said circular ring has a convex curved surface facing the annular surface of the rotor, an annular portion of said convex curved surface being biased into engagement with said annular surface of the rotor.

15. The potentiometer of claim 1 wherein: the first means attached to the housing means for limiting rotation of the rotor comprise a pair of stops on said housing means, said rotor having a tab engageable with the stops to limit rotational movement of the wiper and stop movement of the contact portion of the wiper beyond the first and second ends of the resistive strip.

16. The potentiometer of claim 1 wherein: the first means includes a pair of stops on the outside of the housing means, said rotor having a head, said head having a tab selectively engageable with said stops to limit rotation of said rotor.

17. The potentiometer of claim 1 wherein: the second means includes a pair of stops on the inside of the housing means, said wiper having an arm engageable with said stops to limit rotation of the wiper.

18. The potentiometer of claim 17 wherein: said second means includes an arcuate rib having end shoulders providing said pair of stops.

19. The potentiometer of claim 1 wherein: the first means includes a pair of first stops on the outside of the housing means, said rotor having a head, said head having a tab selectively engageable with said first stops to limit rotation of said rotor, the second means includes a pair of second stops on the inside of the housing means, said wiper having an arm engageable with the second stops to limit rotation of the wiper.

20. The potentiometer of claim 1 wherein: said housing means is comprised of a base and a cover assembled to the base, said rotor being assembled to the cover and having a rotor stem extending through an opening in the cover, and a head on the opposite end of the stem outside of the housing means, said cover having an annular groove around the opening accommodating the rotor stem open to the head, an annular resilient member located in said groove, said head of the rotor being in sliding friction contact with the annular resilient member in the groove.

21. The potentiometer of claim 20 wherein: said cover has a pair of annular shoulders located in said groove and an annular recess between said shoulders, said annular seal having separate annular portions engageable with said shoulders to locate the annular seal in said groove.

22. The potentiometer of claim 21 wherein: said annular seal is a flexible circular member having a generally semicircular cross section.

23. The potentiometer of claim 1 wherein: said wiper is a generally disc shaped member having a curved interior circumferential slot forming a circumferential, resilient contact rim, said rim being curved away from the plane of the wiper and having said contact portion in resilient contact with the resistive strip.

24. The potentiometer of claim 1 including: a switch mechanism cooperating with the stem operable to open an electrical circuit in response to rotation of the rotor to a selected position.

25. A potentiometer comprising: housing means having a chamber; a rotor having a stem rotatably assembled on the housing means, said stem extending into the chamber and said rotor having a portion extending outside of the chamber and housing means for manual manipulation to rotate the stem; an electrical wiper located on the stem, said wiper having a contact portion; a C-shaped resistive strip mounted on the housing means in the chamber, said strip having a first end and a second end with variable electrical resistance means between the first end and the second end; first terminal means electrically connected to the wiper; second terminal means electrically connected to the resistive strip; said wiper having contact means in engagement with the resistive strip and rotatable with the rotor stem from the first end of the resistive strip to the second end of the resistive strip whereby the resistance between the first terminal means and the second terminal means is varied; annular resilient means cooperating with the housing means and rotor for continuous friction braking said rotor; means attached to the housing means and engageable with the rotor for limiting rotation of the rotor to allow the contact portion to move between the first end and second end of the resistive strip, and a switch mechanism cooperating with the stem operable to open an electrical circuit in response to rotation of the rotor to a selected position, said switch mechanism including a cam mounted on the stem, first contact means and second contact means mounted on the housing means, said cam being movable into engagement with the first contact means to separate the first contact means from the second contact means to open said electrical circuit.

26. The potentiometer of claim 25 including: tooth means on said cam to facilitate the release of the first contact means from the second contact means.

27. The potentiometer of claim 25 wherein: the housing means comprises a base supporting the resistive strip, a body mounted on the base, and a cover mounted on the body, said cover having means for rotatably supporting the stem.

28. The potentiometer of claim 25 wherein: said rotor includes a head having a surface located adjacent a portion of the housing means, said portion of the housing means having an annular groove open to said surface of the head, an annular seal located in said groove, said seal having an annular portion located in sliding contact with said surface of the head.

29. The potentiometer of claim 28 wherein: said housing means has a pair of annular shoulders located in said groove and an annular recess between said shoulders, said annular seal having separate annular portions engageable with said annular shoulders to locate the annular seal in said groove.

30. The potentiometer of claim 28 wherein: said annular seal is a flexible circular member.

31. A potentiometer comprising: housing means having a chamber, a rotor having a stem rotatably mounted on the housing means, said stem extended into the chamber, said rotor having a head located adjacent a portion of the housing means outside of the chamber for manual manipulation of the rotor, an electrical wiper located on the stem, said wiper having a contact portion, an electrical resistive strip mounted on the housing means in the chamber, said strip having first and second ends and variable electrical resistive means between the first end and second end thereof, a first set of terminals electrically connected to said wiper, a second set of terminals electrically connected to said wiper, said wiper having a contact portion in engagement with resistive strip and rotatable upon the rotor stem from the first end of the resistive strip to the second end of the resistive strip whereby the resistance between the first set of terminals and the second set of terminals is varied, said housing means having an annular groove open to said surface of the head, an annular seal located in said groove, said annular seal having an annular portion located in sliding contact with said surface of the head to frictionally hold said head in a selected position, and means attached to the housing means for limiting rotation of the rotor comprising an arcuate rib having end shoulders engageable with the wiper to limit rotation of the wiper and stop movement of the contact portion of the wiper beyond the first and second ends of the resistive strip, said arcuate rib having an arcuate surface engageable with an arcuate portion of the resistive strip to locate the strip on the housing means.

32. The potentiometer of claim 31 wherein: said housing means has a pair of annular shoulders located in said groove, and an annular recess between said shoulders, said annular seal having separate annular portions engageable with said shoulders to locate the annular seal in said groove.

33. The potentiometer of claim 32 wherein: said annular seal is a flexible circular member.

34. The potentiometer of claim 33 wherein: the circular member has a semi-circular cross section.

35. The potentiometer of claim 31 wherein: said wiper includes an arm extended from the wiper, said shoulders extended from the housing means inside the chamber and oriented in obstructing relationship relative to the arm on the wiper, such that the arm on the wiper hits one of the shoulders when the contact portion of the wiper is at a first end of the resistive strip, and the arm on the wiper hits the opposite shoulder when the contact portion of the wiper is at the second end of the resistive strip.

36. A potentiometer comprising: housing means having a chamber, a rotor having a stem rotatably mounted on the housing means, said stem extended into the chamber, said rotor having a head located adjacent a portion of the housing means outside of the chamber for manual manipulation of the rotor, an electrical wiper located on the stem, said wiper having a contact portion, an electrical resistive strip mounted on the housing means in the chamber, said strip having first and second ends and variable electrical resistive means between the first end and second end thereof, first set of terminals electrically connected to said wiper, a second set of terminals electrically connected to said wiper, said wiper having a contact portion in engagement with resistive strip and rotatable upon the rotor stem from the first end of the resistive strip to the second end of the resistive strip whereby the resistance between the first set of terminals and the second set of terminals is varied, said housing means having an annular groove open to said surface of the head, an annular seal located in said groove, said annular seal having an annular portion located in sliding contact with said surface of the head to frictionally hold said head in a selected position, first means attached to the housing means for limiting rotation of the rotor between first and second positions, said first means including a pair of stops on the outside of the housing means, said rotor having a tab selectively engageable with said stops to limit rotation of said rotor, and second means attached to the housing means engageable with the wiper to limit rotation of the wiper between the first and second ends of the resistive strip, said wiper engaging said second means on initial rotation of the rotor to hold the wiper in an end position until the rotor engages the first means whereby the wiper is circumferentially orientated with the rotor.

37. The potentiometer of claim 36 wherein: the second means includes a pair of stops on the inside of the housing means, said wiper having an arm engageable with said stops to limit rotation of the wiper.

38. The potentiometer of claim 37 wherein: said second means includes an arcuate rib having end shoulders providing said pair of stops.

39. The potentiometer of claim 36 wherein: the housing means comprises a base supporting the resistive strip, and a cover mounted on the base, said cover having means rotatably supporting the stem and said groove for supporting said annular seal.

40. The potentiometer of claim 39 including: a switch mechanism cooperating with the stem operable to open an electrical circuit in response to the rotation of the rotor to a selected position.

41. The potentiometer of claim 40 wherein: the switch mechanism includes a cam mounted on the stem, contact means mounted on the housing means, said cam being movable into engagement with the contact means to open said electrical circuit.

42. A potentiometer comprising: housing means having a chamber; rotor means rotatably mounted on the housing means, said rotor means having a first member located outside of the housing means and a second member rotatably mounted on the housing means; an electrical wiper mounted on the second member; resistive strip means located in the chamber and mounted on the housing means, said strip means having a first end and a second end, said wiper being engageable with said strip means; electrical conductor means connected to said strip means and wiper; first means on the housing means for limiting rotation of the rotor means between first and second positions; and second means attached to the housing means and located in the chamber engageable with the wiper to limit rotation of the wiper between the first and second ends of the resistive strip means, said wiper engaging said second means on initial rotation of the rotor to hold the wiper in an end position until the rotor engages the first means whereby the wiper is circumferentially orientated with the rotor.

43. The potentiometer of claim 42 wherein: the first means includes a pair of stops on the outside of the housing means, said rotor having a tab selectively engageable with said stops to limit rotation of said rotor.

44. The potentiometer of claim 42 wherein: the second means includes a pair of stops on the inside of the housing means, said wiper having an arm engageable with said stops to limit rotation of the wiper.

45. The potentiometer of claim 44 wherein: said second means includes an arcuate rib having end shoulders providing said pair of stops.

46. The potentiometer of claim 42 wherein: the first means includes a pair of first stops on the outside of the housing means, said rotor having a tab selectively engageable with said first stops to limit rotation of said rotor, the second means includes a pair of second stops on the inside of the housing means, said wiper having an arm engageable with the second stops to limit rotation of the wiper.

* * * * *